US011772251B2

(12) United States Patent
Zhou

(10) Patent No.: US 11,772,251 B2
(45) Date of Patent: Oct. 3, 2023

(54) CRIMPING PLIERS

(71) Applicant: YUEQING FIVESTAR HARDWARE TOOLS FACTORY, Yueqing (CN)

(72) Inventor: Lijin Zhou, Yueqing (CN)

( * ) Notice: Subject to any disclaimer, the term of this patent is extended or adjusted under 35 U.S.C. 154(b) by 256 days.

(21) Appl. No.: 17/389,389

(22) Filed: Jul. 30, 2021

(65) Prior Publication Data

US 2022/0388139 A1 Dec. 8, 2022

(30) Foreign Application Priority Data

Jun. 3, 2021 (CN) ..... 202121238676.6

(51) Int. Cl.

| | |
|---|---|
| ***B25B 7/06*** | (2006.01) |
| ***B25F 1/00*** | (2006.01) |
| ***B25B 7/22*** | (2006.01) |
| ***B25F 1/04*** | (2006.01) |
| ***B21D 39/04*** | (2006.01) |
| ***B25B 27/10*** | (2006.01) |
| ***B25B 27/14*** | (2006.01) |

(52) U.S. Cl.

CPC ..... *B25F 1/003* (2013.01); *B21D 39/046* (2013.01); *B21D 39/048* (2013.01); *B25B 7/06* (2013.01); *B25B 7/22* (2013.01); *B25B 27/10* (2013.01); *B25B 27/14* (2013.01); *B25F 1/04* (2013.01)

(58) Field of Classification Search

CPC ..... B21D 39/046; B21D 39/048; B25B 7/06; B25B 27/14; B25F 1/003; B25F 1/04

USPC ..... 72/409.01, 409.08, 409.12, 409.19

See application file for complete search history.

(56) References Cited

U.S. PATENT DOCUMENTS

| | | | | |
|---|---|---|---|---|
| 5,870,925 | A * | 2/1999 | Morris | B25B 27/146 81/313 |
| 6,289,712 | B1 * | 9/2001 | Beetz | B25B 27/10 72/409.16 |
| 7,997,116 | B2 * | 8/2011 | Norin | B25B 27/146 72/409.11 |
| 8,286,461 | B2 * | 10/2012 | Hofmann | B25B 27/10 81/348 |
| 8,312,755 | B1 * | 11/2012 | Steiner | B25B 25/005 72/409.11 |
| 2009/0183547 | A1 * | 7/2009 | Battenfeld | B25B 27/146 72/409.12 |
| 2011/0214538 | A1 * | 9/2011 | Huang | B25B 27/205 29/229 |

(Continued)

*Primary Examiner* — Edward T Tolan

(74) *Attorney, Agent, or Firm* — Daniel M. Cohn; Howard M. Cohn

(57) ABSTRACT

Crimping pliers include a clamping assembly including a left jaw and a right jaw, a control mechanism, and a rotating button mechanism. The left jaw includes a left connecting portion and a left head. The right jaw includes a right connecting portion and a right head. The control mechanism drives the clamping assembly to switch between a clamping state and an open state. The rotating button mechanism includes a first connecting plate connected to the right connecting portion, an eccentric shaft, a rotating button connected to the eccentric shaft, and a limiting structure connected to the rotating button to limit a rotating range of the rotating button. The first connecting plate is rotatably connected to the left connecting portion through the eccentric shaft. The rotating button adjusts a distance between the (Continued)

left connecting portion and the right connecting portion by driving the eccentric shaft to eccentrically rotate.

9 Claims, 3 Drawing Sheets

(56) References Cited

U.S. PATENT DOCUMENTS

2019/0344404 A1* 11/2019 Chen ..... B25B 7/14

* cited by examiner

CRIMPING PLIERS

TECHNICAL FIELD

The present disclosure relates to a field of clamping, crimping and cutting technology, and in particular to crimping pliers.

BACKGROUND

At present, with vigorous development of domestic infrastructure construction, application of plastic pipes and metal pipes has become more and more frequent. Plastic pipes and metal pipes are generally connected by pipe couplings. Compared with heat-consuming methods such as welding, connecting pipes using the pipe couplings is not only safe and reliable, but also convenient for construction without compromising material performance. The connection of the pipe couplings and the pipes is generally realized by crimping of crimping pliers. Based on the special structure of the crimping pliers, an operator usually need to use jaws of the crimping pliers to pull out nails. However, sizes of the nail caps of the nails are different, and a size of the jaws of the crimping pliers is fixed, so that the conventional crimping pliers are unable to adapt to different sizes of nails.

SUMMARY

An object of the present disclosure is to provide crimping pliers, which aim to solve a technical problem that crimping pliers in the prior art can only achieve a crimping function but unable to achieve a cutting function.

The present disclosure provides crimping pliers. The crimping pliers comprise a clamping assembly, a control mechanism, and a rotating button mechanism. The clamping assembly comprises a left jaw and a right jaw. The left jaw comprises a left connecting portion and a left head connected to the left connecting portion. The right jaw comprises a right connecting portion and a right head connected to the right connecting portion. The clamping assembly comprises a clamping state when the left head moves close to the right head, and an open state when the left head moves away from the right head. The control mechanism is configured to drive the clamping assembly to switch between the clamping state and the open state. The rotating button mechanism comprises a first connecting plate, an eccentric shaft, a rotating button, and a limiting structure. The first connecting plate is connected to the right connecting portion. The first connecting plate is rotatably connected to the left connecting portion through the eccentric shaft. The rotating button is connected to the eccentric shaft. The rotating button adjusts a distance between the left connecting portion and the right connecting portion by driving the eccentric shaft to eccentrically rotate. The limiting structure is connected to the rotating button. The limiting structure is configured to limit a rotating range of the rotating button.

In one embodiment, the rotating button mechanism further comprises a sliding structure arranged on the first connecting plate. The limiting structure is slidably connected to the sliding structure.

In one embodiment, the sliding structure is a sliding groove disposed in the first connecting plate. The sliding groove extends circumferentially around the eccentric shaft. The limiting structure is a positioning column movably connected to the rotating button. The positioning column is slidably connected to the sliding groove.

In one embodiment, the first connecting plate comprises a first positioning structure and a second positioning structure spaced apart from the first positioning structure. The limiting structure is connected to the first positioning structure or the second positioning structure.

In one embodiment, the first positioning structure and the second positioning structure are positioning holes on the first connecting plate. An opening direction of the positioning holes is parallel to a rotation axis of the rotating button. The limiting structure matches the positioning holes. The limiting structure is inserted into and connected to the first positioning structure or the second positioning structure.

In one embodiment, when the limiting structure is connected to the first positioning structure, the left head abuts against the right head when the clamping assembly is in the clamping state. When the limiting structure is connected to the second positioning structure, the left head separates from the right head when the clamping assembly is in the clamping state.

In one embodiment, the sliding structure is arranged between the first positioning structure and the second positioning structure.

In one embodiment, the crimping pliers further comprise a second connecting plate. The clamping assembly is arranged between the first connecting plate and the second connecting plate. The second connecting plate is connected to the right jaw. The eccentric shaft comprises a first rotating shaft, a second rotating shaft, and a third rotating shaft. The first rotating shaft is rotatably connected to the first connecting plate. The second rotating shaft is connected to the first rotating shaft and is rotatably connected to the left connecting portion. The third rotating shaft is connected to the second rotating shaft and is rotatably connected to the second connecting plate. A rotation axis of the first rotating shaft is parallel to and not coincided with a rotation axis of the second rotating shaft. The rotation axis of the first rotating shaft coincides with a rotation axis of the third rotating shaft. The rotating button is connected to the first rotating shaft and drives the eccentric shaft to rotate around the rotation axis of the first rotating shaft.

In one embodiment, the first rotating shaft comprise a cut surface. The rotating button comprises a connecting hole matched with the first rotating shaft.

In one embodiment, the left head comprises a left avoidance groove penetrating along an axial direction of the eccentric shaft. The right head comprises a right avoidance groove penetrating along the axial direction of the eccentric shaft. An opening of the left avoidance groove faces an opening of the right avoidance groove. An avoidance hole communicated with the left avoidance groove and the right avoidance groove is on the second connecting plate.

Compared with the prior art, the clamping assembly of the crimping pliers is able to switch between the clamping state and the open state by the control mechanism. In other words, the control mechanism drives the left head of the left jaw and the right head of the right jaw to move toward or away from each other. When the control mechanism drives the clamping assembly to switch from the open state to the clamping state, the clamping assembly crimps a pipe coupling or cut the pipe coupling. When the control mechanism drives the clamping assembly to switch from the clamping state to the open state, jaws of the clamping assembly loosen the pipe coupling. The first connecting plate is connected to the right connecting portion, the eccentric shaft is respectively rotatably connected to the left connecting portion and the first connecting plate, so that the left connecting portion is hinged to the right connecting portion and the rotating button is connected to the eccentric shaft. When the rotating button rotates, the eccentric shaft rotates eccentrically, and the distance between the left connecting portion and the right connecting portion changes with a rotation of the eccentric shaft, which changes a maximum distance between the left head and the right head and changes a minimum distance between the left head and the right head. The limiting structure limits a rotating range of the rotating button. Within the rotating range defined by the limiting structure, the rotating button is able to rotate freely, so that the distance between the left connecting portion and right connecting portion is changed freely. When a nail pulling operation is performed, the distance between the left head and the right head is adjusted adaptively according to a size of a nail to be pulled, so that the crimping pliers are able to pull out nails of different sizes, which improves an application scope of the crimping pliers in the nail pulling operation, and increases a functional diversity of crimping pliers.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor. In the drawing.

In the drawings.

Figure 1:
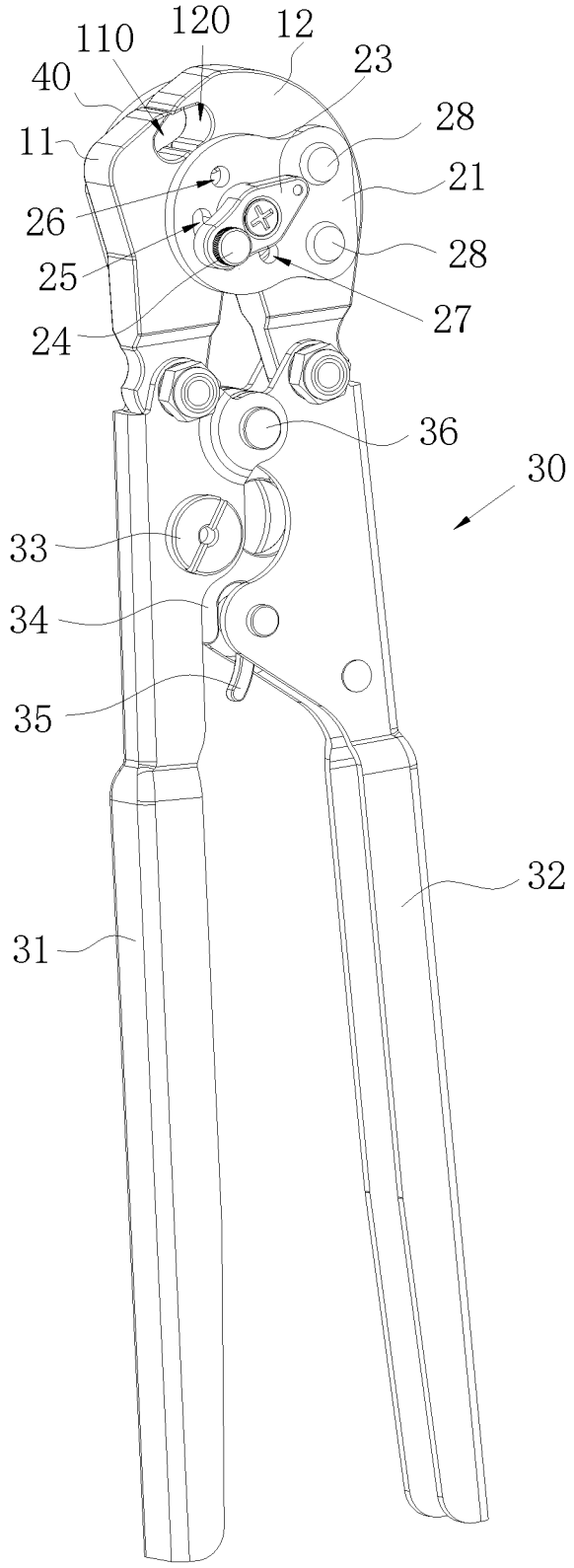
FIG. 1 is a perspective schematic diagram of crimping pliers according to one embodiment of the present disclosure.

11—left jaw; 101—left avoidance groove; 102—right avoidance groove; 103—second through hole; 111—left head; 112—left connecting portion; 113—left control portion; 12—right jaw; 121—right head; 122—right connecting portion; 123—right control portion; 21—first connecting plate; 22—eccentric shaft; 221—first rotating shaft; 222—second rotating shaft; 223—third rotating shaft; 23—rotating button; 24 limiting structure; 25—sliding structure; 26—first positioning structure; 27—second positioning structure; 28—fixing column; 30—control mechanism; 31—left plier rod; 32—right plier rod; 33—eccentric button; 34—ratchet tooth; 35—pawl; 36—rotation shaft; 40—second connecting plate; 401—avoidance hole.

DETAILED DESCRIPTION

Embodiments of the present disclosure are described in detail below. Examples of the embodiments are shown in accompanying drawings, in which same or similar reference numerals indicate the same or similar elements or elements with the same or similar functions. The embodiments described below with reference to the drawings are exemplary, and are intended to explain the present disclosure, but should not be regarded as a limitation to the present disclosure.

It should be understood in the description of the present disclosure that terms such as "inner", "outer", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

In addition, terms such as "first" and "second" are only used for the purpose of description, rather than being understood to indicate or imply relative importance or hint the number of indicated technical features. Thus, the feature limited by "first" and "second" can explicitly or impliedly include one or more features. In the description of the present disclosure, the meaning of "a plurality of" is two or more unless otherwise specified.

It should be noted in the description of the present disclosure that, unless otherwise regulated and defined, terms such as "installation," "bonded," and "bonding" shall be understood in broad sense, and for example, may refer to fixed bonding or detachable bonding or integral bonding; may refer to mechanical bonding or electrical bonding; and may refer to direct bonding or indirect bonding through an intermediate medium or inner communication of two elements. For those of ordinary skill in the art, the meanings of the above terms in the present disclosure may be understood according to concrete conditions.

In order to make the purpose, technical solutions, and advantages of the present disclosure clear, the following further describes the present disclosure in detail with reference to accompanying drawings and embodiments.

The present disclosure provides crimping pliers. The crimping pliers comprise a clamping assembly, a control mechanism 30, and a rotating button mechanism. The crimping pliers are configured to clamp and crimp pipe couplings, or other structures that need to be crimped. The crimping pliers are also configured to cut the pipe couplings or other structures that need to be cut. For the crimping pliers in the embodiment, jaws of the crimping pliers are configured to pull out nails.

Figure 3:
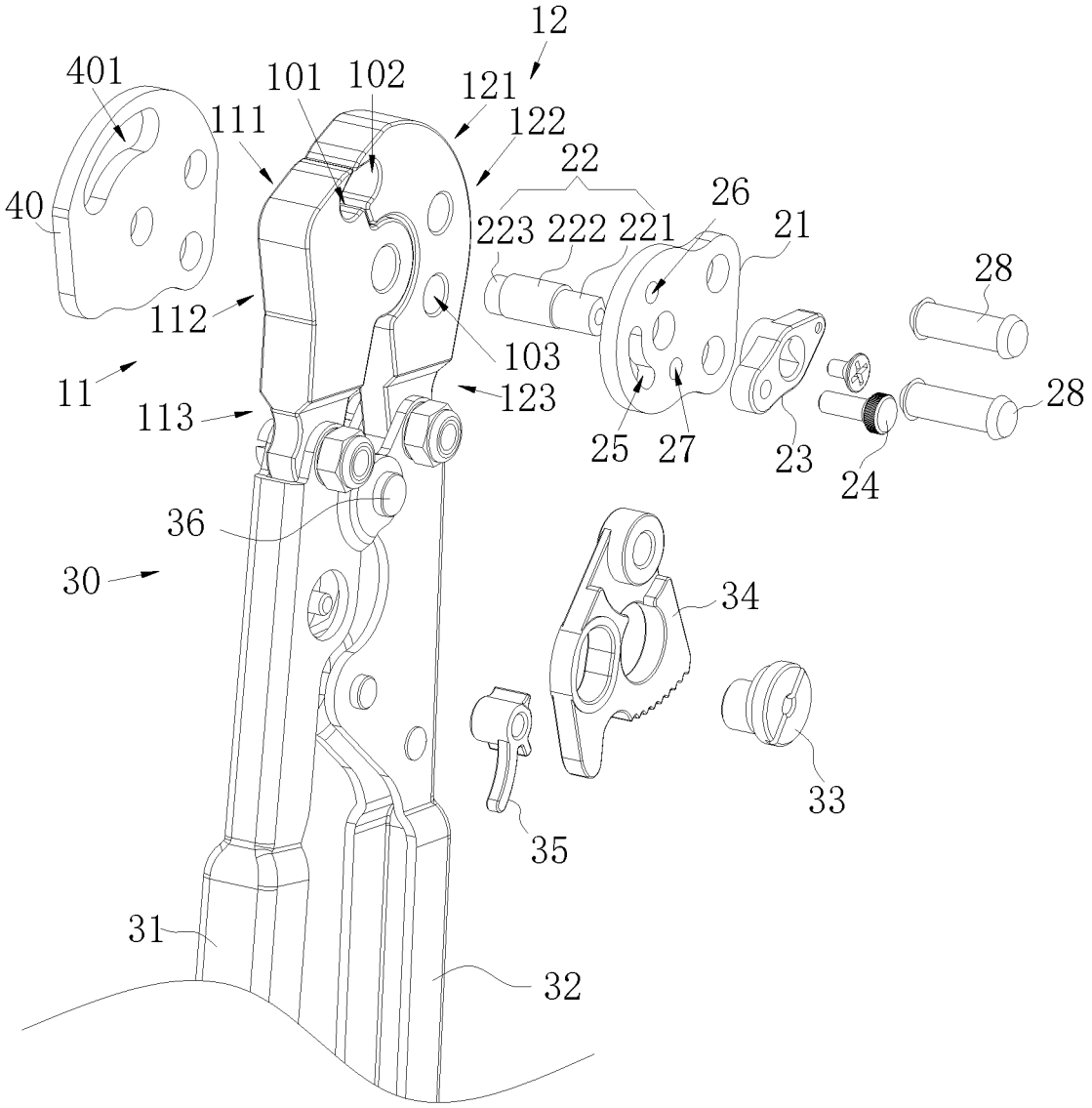
FIG. 3 is an exploded schematic diagram of the crimping pliers shown in FIG. 1.

As shown in FIGS. 1 and 3, the clamping assembly comprises a left jaw 11 and a right jaw 12. The left jaw 11 comprises a left connecting portion 112 and a left head 111 connected to the left connecting portion 112. The right jaw 12 comprises a right connecting portion 122 and a right head 121 connected to the right connecting portion 122. The left connecting portion 112 is hinged with the right connecting portion 122 by the rotating button mechanism.

The clamping assembly comprises a clamping state when the left head 112 moves close to the right head 121, and an open state when the left head 121 moves away from the right head 111. The clamping assembly is capable of switching between the clamping state and the open state via an external force. When the clamping assembly is in the clamping state, a distance between the left head 111 and the right head 121 is the shortest. At this time, the left head 111 and the right head 121 are spaced apart for crimping, or they abut against each other to perform a cutting operation. When the clamping assembly is in the open state, the distance between the left head 111 and the right head 121 is farthest to separate from a pipe coupling or other clamped structure.

The control mechanism 30 is configured to drive the clamping assembly to switch between the clamping state and the open state. It is understood that the control mechanism 30 drives the left jaw 11 and the right jaw 12 to rotate with respect to each other to achieve approaching and separation of the left head 111 and the right head 121. As shown in FIGS. 1 and 3, the control mechanism 30 comprises a left plier rod 31 and a right plier rod 32. The left plier rod 31 is connected to the left jaw 11, and the right plier rod 32 is connected to the right jaw 12. An operator is able to control the left plier rod 31 and the right plier rod 32 to gradually close to or separate from each other to achieve a relative rotation of the left jaw 11 and the right jaw 12, thereby achieving the approaching and separation of the left head 111 and the right head 121.

In the embodiment, as shown in FIGS. 1 and 3, the left jaw 11 further comprises a left control portion 113 connected to the left connecting portion 112. The left head 111 and the left control portion 113 are respectively arranged on two sides of the left connecting portion 112. The right jaw 12 further comprises a right control portion 123 connected to the left connecting portion 122. The right head 121 and the right control portion 123 are respectively arranged on two sides of the right connecting portion 122. A middle portion of the left plier rod 31 is hinged with a middle portion of the right plier rod 32. One end of the left plier rod 31 is connected to the left control portion 113. One end of the right plier rod 32 is connected to the right control portion 123. A free end of the left plier rod 31 and a free end of the right plier rod 32 are configured for operation by the operator. When the operator grips the free end of the left plier rod 31 and the free end of the right plier rod 32, the left control portion 113 and the right control portion 123 move away from each other to make the left head 111 and the right head 121 move close to each other. At this time, the clamping assembly is switched to the clamping state. When the operator loosens the free end of the left plier rod 31 and the free end of the right plier rod 32, the free end of the left plier rod 31 and the free end of the right plier rod 32 move away from each other, the left control portion 113 and the right control portion 123 move close to each other to make the left head 111 to separate from the right head 121. At this time, the clamping assembly is switched to the open state.

As shown in FIGS. 1 and 3, the left plier rod 31 and the right plier rod 32 are able to realize unidirectional rotation through cooperation of a ratchet tooth 34 and a pawl 35. Specifically, the left plier rod 31 is hinged with the right plier rod 32 through a rotating shaft 36. The ratchet tooth 34 is rotatably connected to the rotating shaft 36, the ratchet tooth 34 comprises a tooth portion. The pawl 35 is connected to the right plier rod 32 and is opposite to the tooth portion. When the free end of the left plier rod 31 and the free end of the right plier rod 32 move toward each other, a movement of the pawl 35 is not limited. When the free end of the left plier rod 31 and the free end of the right plier rod 32 move away from each other, the pawl 35 is clamped in the tooth portion to limit the free end of the left plier rod 31 from separating from the free end of the right plier rod 32. Therefore, when the left head 111 and the right head 121 perform a cutting or a crimping operation, they can stay at a current position when the operator accidentally releases or relaxes his hand. When the operator continues to operate the crimping pliers, he can continue the operation from the current position of the left head 111 and the right head 121 again, which is convenient and quick to use.

Optionally, the ratchet tooth 34 is connected to the left plier rod 31 through an eccentric button 33. By adjusting the eccentric button 33, when the operator grips a same distance, the left jaw 11 and the right jaw 12 apply a greater force to the clamped structure, which makes the operation of the operator easy and labor-saving.

As shown in FIGS. 1 and 3, the rotating button mechanism comprises a first connecting plate 21, an eccentric shaft 22, the rotating button 23, and a limiting structure 24. The first connecting plate 21 is connected to the right connecting portion 122. The first connecting plate 21 is rotatably connected to the left connecting portion 112 through the eccentric shaft 22. The rotating button 23 is connected to the eccentric shaft 22. The rotating button 23 adjusts a distance between the left connecting portion 112 and the right connecting portion 122 by driving the eccentric shaft 22 to eccentrically rotate. The limiting structure 24 is connected to the rotating button 23. The limiting structure 24 is configured to limit a rotating range of the rotating button 23.

It is understood that the eccentric shaft 22 comprises a first rotating shaft 221 and a second rotating shaft 222. The first rotating shaft 221 is rotatably connected to the first connecting plate 21. The second rotating shaft 221 is connected to the first rotating shaft 221 and is rotatably connected to the left connecting portion 112. A rotation axis of the first rotating shaft is parallel to and not coincided with a rotation axis of the second rotating shaft. The rotating button 23 is connected to the first rotating shaft 221. The rotation axis of the first rotating shaft 221 coincides with a rotation axis of the rotating button 23. The rotating button 23 rotates to drive the first rotating shaft 221 to rotate, so that the second rotating shaft 222 rotates around the rotation axis of the first rotating shaft. The second rotating shaft 222 drives the left connecting portion 112 to move close to or away from the right connecting portion 122. The rotating button 23 may be in a shape of a pointer, and comprises a rotating portion spaced apart from a rotation axis of the rotating button. The rotating portion rotates around a central axis of the first rotating shaft 221. The limiting structure 24 is arranged on the rotating portion. The rotating button 23 is capable of rotating freely without the external force. The limiting structure 24 is configured to limit a rotating range of the rotating button 23.

In order to prevent rotation of the rotating button 23 with respect to the first rotating shaft 221, the first rotating shaft 221 comprises a cut surface, and the rotating button 23 comprises a connecting hole matched with the first rotating shaft 221. Thus, a cross-section of the first rotating shaft 221 is non-circular, and the connecting hole is correspondingly non-circular. The cut surface limits a position of the rotating button 23.

As shown in FIGS. 1 and 3, specifically, the first connecting plate 21 is provided with at least one first through hole, the right connecting portion 122 is correspondingly provided with at least one second through hole 103. The crimping pliers further comprise at least one fixing column 28. Each fixing column 28 passes through each first through hole and each second through hole to connect the first connecting plate 21 and the right connecting portion 122. In the embodiment, the first connecting plate 21 comprises two first through holes, the right connecting portion 122 comprises two second through holes 103, and two fixing columns 28 separately pass through one corresponding first through hole and one corresponding second through hole 103. Therefore, the rotation of the first connecting plate 21 relative to the right connecting part 122 is limited.

The clamping assembly of the crimping pliers is able to switch between the clamping state and the open state by the control mechanism 30. In other words, the control mechanism 30 drives the left head 111 of the left jaw 11 and the right head 121 of the right jaw 12 to move toward or away from each other. When the control mechanism 30 drives the clamping assembly to switch from the open state to the clamping state, the clamping assembly crimps the pipe coupling or cut the pipe coupling. When the control mechanism 30 drives the clamping assembly to switch from the clamping state to the open state, jaws of the clamping assembly loosen the pipe coupling. The first connecting plate 21 is connected to the right connecting portion 122, the eccentric shaft 22 is respectively rotatably connected to the left connecting portion 112 and the first connecting plate 21, so that the left connecting portion 112 is hinged to the right connecting portion 122 and the rotating button 23 is connected to the eccentric shaft 22. When the rotating button 23 rotates, the eccentric shaft 22 rotates eccentrically, and the distance between the left connecting portion and the right connecting portion changes with the rotation of the eccentric shaft 22, which changes a maximum distance between the left head 111 and the right head 121 and changes a minimum distance between the left head 111 and the right head 121. The limiting structure 24 limits a rotating range of the rotating button 23. Within the rotating range defined by the limiting structure 24, the rotating button 23 is able to rotate freely, so that the distance between the left connecting portion 112 and right connecting portion 122 is changed freely. When a nail pulling operation is performed, the distance between the left head 111 and the right head 121 is adjusted adaptively according to a size of a nail to be pulled, so that the crimping pliers are able to pull out nails of different sizes, which improves an application scope of the crimping pliers in the nail pulling operation, and increases a functional diversity of crimping pliers.

As shown in FIGS. 1 and 3, specifically, the left head 111 comprises a left avoidance groove 101 penetrating along an axial direction of the eccentric shaft 22. The right head 121 comprises a right avoidance groove 102 penetrating along the axial direction of the eccentric shaft 22. An opening of the left avoidance groove 101 faces an opening of the right avoidance groove 102. By the arrangement of the left avoidance groove 101, the left head 111 is hook-shaped. By the arrangement of the right avoidance groove 102, the right head 121 is hook-shaped. The arrangements of the hook-shaped left avoidance groove 101 and the hook-shaped left avoidance groove make a clamping portion of the clamping assembly precise. Meanwhile, the line of sight of the operator is not affected. Furthermore, the arrangements of the left avoidance groove 101 and the right avoidance groove 102 also avoid certain structural pieces and avoid affecting the crimping action of the crimping pliers. Moreover, the hook-shaped structure is convenient for the nail pulling operation, and it is convenient for the left jaw 11 or the right jaw 12 to be inserted under the nail cap of the nail.

In the embodiment, the limiting structure 24 may be a positioning column that passes through the rotating button 23. The positioning column passes through the rotating button 23 and extends toward the clamping assembly. When the positioning column abuts against the first connecting plate 21, the rotating button 23 stops rotating relative to the first connecting plate 21. At this time, the distance between the left connecting portion 112 and the right connecting portion 122 is fixed. In another embodiment, the limiting structure 24 may be a groove-like structure arranged on the rotating button 23. The first connecting plate 21 comprises a stopping protrusion protruding away from the clamping assembly. When the stopping protrusion abuts against a groove wall of the groove-like structure, the rotating button 23 stops rotating.

In one embodiment, the rotating button mechanism further comprises a sliding structure 25 arranged on the first connecting plate 21. The limiting structure 24 is slidably connected to the sliding structure 25. The sliding structure 25 provides a movement path for the limiting structure 24. The limiting structure 24 abuts against an extension end of the sliding structure 25 to limit the rotation of the rotating button 23.

In the embodiment, the sliding structure 25 is a sliding groove disposed in the first connecting plate 21. The sliding groove 25 extends circumferentially around the eccentric shaft 22. The limiting structure 24 is the positioning column movably connected to the rotating button. The positioning column is slidably connected to the sliding groove.

When the rotating button 23 rotates, the positioning column slides along the extending direction of the sliding groove. When the positioning column abuts against the groove wall at the extension end of the sliding groove, the rotating button stops rotating. The sliding groove limits the rotating range of the rotating button 23, and limits an adjustable range of the distance between the left connecting portion 112 and the right connecting portion 122.

The distance between the left head 111 and the right head 121 is adaptively adjusted according to the size of the nail to be pulled within the above-mentioned adjustable range. Optionally, the sliding groove matches the positioning column. At this time, the positioning column is unable to move, and when the clamping assembly is in the clamping state or the open state, the distance between the left head 111 and the right head 121 is fixed. It should be noted that a central angle corresponding to the sliding groove is less than 180°.

As shown in FIGS. 1 and 3, optionally, the first connecting plate 21 comprises a first positioning structure 26 and a second positioning structure 27 spaced apart from the first positioning structure 26. The limiting structure 24 is connected to the first positioning structure 26 or the second positioning structure 27. That is, both of the first positioning structure 26 and the second positioning structure 27 are arranged on the movement path of the limiting structure 24. During the circular movement of the rotating button 23 around its rotation axis, the limiting structure 24 may be connected with the first positioning structure 24 or the second positioning structure 27. At this time, the limiting structure 24 is unable to move and no matter the clamping assembly is in the clamping state or the open state, the distance between the left head 111 and the right head 121 is fixed. In order to separate the limiting structure 24 from the sliding structure 25, the rotating button 23 comprises a limiting hole, and the positioning column passes through the limiting hole and is slidable along an opening direction of the limiting hole. When the rotating button 23 needs to be positioned in the first positioning structure 26, the limiting structure 24 moves away from the clamping assembly to avoid contacting the sliding structure 25. When the limiting structure 24 moves to a position corresponding to the first positioning structure 26 or a position corresponding to the second positioning structure 27, the limiting structure 24 then moves toward the clamping assembly to connect to the corresponding first positioning structure 26 or the second positioning structure 27.

When the limiting structure 24 is connected to the first positioning structure 26, the left head 111 abuts against the right head 121 when the clamping assembly is in the clamping state. When the limiting structure 24 is connected to the second positioning structure 27, the left head 111 and the right head 121 are separated from each other when the clamping assembly is in the clamping state. That is, the first positioning structure 26 and the second positioning structure 27 are respectively configured to achieve crimping and cutting process of the corresponding clamping assembly. In one embodiment, when the limiting structure 24 is connected to the first positioning structure 26, the left head 111 abuts against the right head 121 when the clamping assembly is in the clamping state, that is, the corresponding clamping assembly is able to cut the pipe coupling when the clamping assembly is switched to the clamping state. When the limiting structure 24 is connected to the second positioning structure 27, the left head 111 is separated from the right head 121 when the clamping assembly is in the clamping state. That is, the corresponding clamping assembly is able to crimp and connect the pipe coupling when the clamping assembly is switched to the clamping state. It is understood that the first positioning structure 26 and the second positioning structure 27 correspond to two ends of a movement track of the rotating button 23. The sliding structure 25 is arranged between the first positioning structure 26 and the second positioning structure 27, so that the left connecting portion 112 and the right connecting portion 122 move between the two end values.

As shown in FIGS. 1 and 3, the first positioning structure 26 and the second positioning structure 27 are positioning holes on the first connecting plate 21. An opening direction of the positioning holes is parallel to the rotation axis of the rotating button 23. The limiting structure matches the positioning holes. When the limiting structure 24 is the positioning column, the positioning column is inserted into any one of the positioning holes so that the limiting structure 24 is connected to the first positioning structure 26 or the second positioning structure 27.

The insert-in connection realizes quick connection between the limiting structure 24 and the first positioning structure 26 or the second positioning structure 27. The positioning column may comprise external threads, an inner wall of any of the positioning holes comprises internal threads, and the positioning column is threadedly connected with any one of the positioning holes, thereby avoiding separation of the positioning column and any one of the positioning holes.

Figure 2:
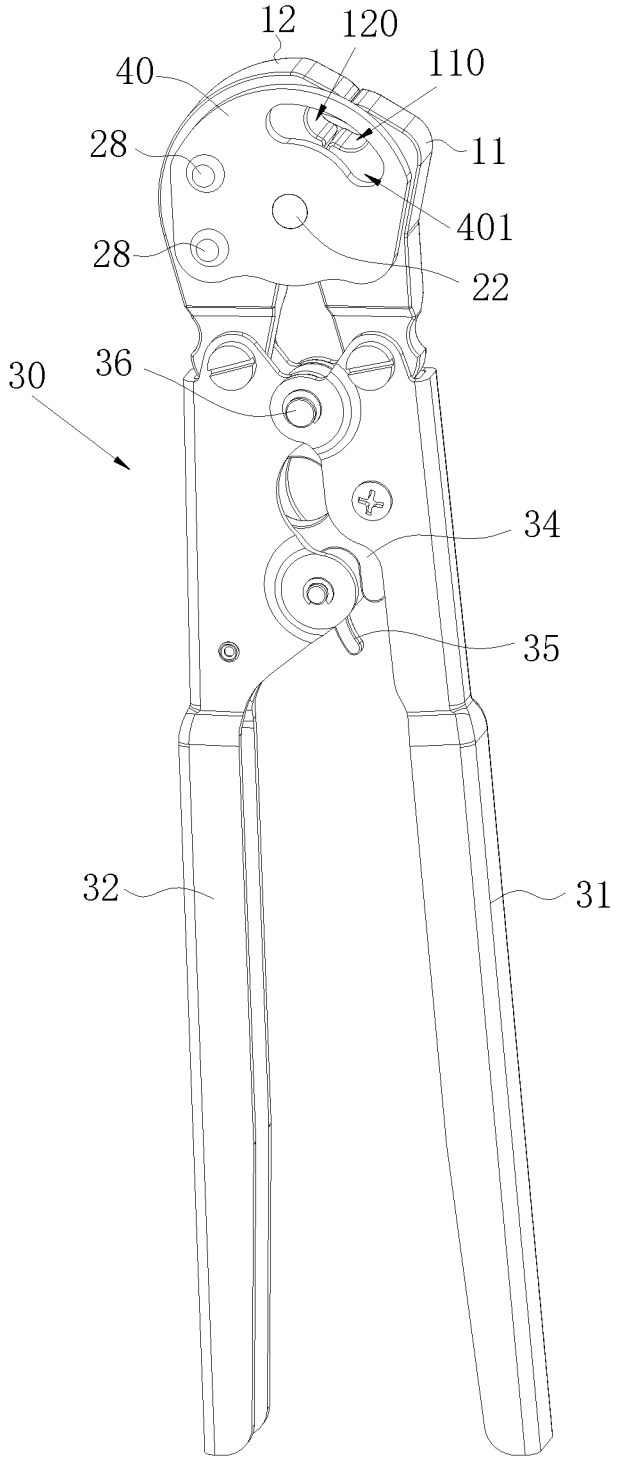
FIG. 2 is another perspective schematic diagram of the crimping pliers shown in FIG. 1.

As shown in FIGS. 2 and 3, in order to further prevent the clamping assembly from separating from the first connecting plate, the crimping pliers further comprise a second connecting plate 40. The clamping assembly is arranged between the first connecting plate 21 and the second connecting plate 40. The second connecting plate 40 is connected to the right jaw through the fixing columns 28.

The eccentric shaft 22 further comprises a third rotating shaft 223 connected to the second rotating shaft 222 and rotatably connected to the second connecting plate 40. The third rotating shaft 223 and the first rotating shaft 221 are respectively arranged on two sides of the second rotating shaft 222. The rotation axis of the second rotating shaft 222 coincides with a rotation axis of the third rotating shaft 223. When the rotating button 23 rotates, the first rotating shaft 221 and the third rotating shaft 223 keep still with respect to the rotating button 23, and the second rotating shaft 222 drives the left jaw 11 to move. Thus, the clamping assembly is clamped between the first connecting plate 21 and the second connecting plate 40 to prevent the left jaw 11 and the right jaw 12 from being misaligned.

As shown in FIGS. 2 and 3, the second connecting plate 40 comprise an avoidance hole 401 communicated with the left avoidance groove 101 and the right avoidance groove 102. The avoidance hole 401 is configured for the operator to observe a clamping condition of the clamping assembly.

The above are only optional embodiments of the present disclosure and specifically depict technical principles of the present disclosure. These descriptions are only for explaining the principles of the present disclosure, and cannot be interpreted as limiting of the protection scope of the present disclosure in any way. Based on the explanations, any modification, equivalent replacement, and improvement made within the spirit and principle of the disclosure, and other specific implementations of the present disclosure obtained by those skilled in the art without creative work, should fall within the protection scope of the present disclosure.

What is claimed is:

1. Crimping pliers, comprising: a clamping assembly, a control mechanism, and a rotating button mechanism;

wherein the clamping assembly comprises a left jaw and a right jaw; the left jaw comprises a left connecting portion and a left head connected to the left connecting portion; the right jaw comprises a right connecting portion and a right head connected to the right connecting portion; the clamping assembly comprises a clamping state when the left head moves close to the right head, and an open state when the left head moves away from the right head;

wherein the control mechanism is configured to drive the clamping assembly to switch between the clamping state and the open state;

wherein the rotating button mechanism comprises a first connecting plate, an eccentric shaft, a rotating button, and a limiting structure; the first connecting plate is connected to the right connecting portion; the first connecting plate is rotatably connected to the left connecting portion through the eccentric shaft, the rotating button is connected to the eccentric shaft; the rotating button adjusts a distance between the left connecting portion and the right connecting portion by driving the eccentric shaft to eccentrically rotate; the limiting structure is connected to the rotating button; the limiting structure is configured to limit a rotating range of the rotating button;

wherein the rotating button mechanism further comprises a sliding structure arranged on the first connecting plate; the limiting structure is slidably connected to the sliding structure;

wherein the first connecting plate comprises a first positioning structure and a second positioning structure spaced apart from the first positioning structure; the limiting structure is connected to the first positioning structure or the second positioning structure.

2. The crimping pliers according to claim 1, wherein the sliding structure is a sliding groove on the first connecting plate; the sliding groove extends circumferentially around the eccentric shaft; the limiting structure is a positioning column movably connected to the rotating button; the positioning column is slidably connected to the sliding groove.

3. The crimping pliers according to claim 1, wherein the first positioning structure and the second positioning structure are positioning holes on the first connecting plate; an opening direction of the positioning holes is parallel to a rotation axis of the rotating button; the limiting structure matches the positioning holes; the limiting structure is inserted into and connected to the first positioning structure or the second positioning structure.

4. The crimping pliers according to claim 1, wherein when the limiting structure is connected to the first positioning structure, the left head abuts against the right head when the clamping assembly is in the clamping state; when the limiting structure is connected to the second positioning structure, the left head separates from the right head when the clamping assembly is in the clamping state.

5. The crimping pliers according to claim 4, wherein the sliding structure is arranged between the first positioning structure and the second positioning structure.

6. The crimping pliers according to claim 1, wherein the crimping pliers further comprise a second connecting plate; the clamping assembly is arranged between the first connecting plate and the second connecting plate; the second connecting plate is connected to the right jaw; the eccentric shaft comprises a first rotating shaft, a second rotating shaft, and a third rotating shaft; the first rotating shaft is rotatably connected to the first connecting plate; the second rotating shaft is connected to the first rotating shaft and is rotatably connected to the left connecting portion; the third rotating shaft is connected to the second rotating shaft and is rotatably connected to the second connecting plate; a rotation axis of the first rotating shaft is parallel to and not coincided with a rotation axis of the second rotating shaft; the rotation axis of the first rotating shaft coincides with a rotation axis of the third rotating shaft; the rotating button is connected to the first rotating shaft and drives the eccentric shaft to rotate around the rotation axis of the first rotating shaft.

7. The crimping pliers according to claim 6, wherein the first rotating shaft comprise a cut surface; the rotating button comprises a connecting hole matched with the first rotating shaft.

8. The crimping pliers according to claim 6, wherein the left head comprises a left avoidance groove penetrating along an axial direction of the eccentric shaft, the right head comprises a right avoidance groove penetrating along the axial direction of the eccentric shaft; an opening of the left avoidance groove faces an opening of the right avoidance groove; an avoidance hole communicated with the left avoidance groove and the right avoidance groove is on the second connecting plate.

9. Crimping pliers, comprising: a clamping assembly, a control mechanism, and a rotating button mechanism;

wherein the clamping assembly comprises a left jaw and a right jaw; the left jaw comprises a left connecting portion and a left head connected to the left connecting portion; the right jaw comprises a right connecting portion and a right head connected to the right connecting portion; the clamping assembly comprises a clamping state when the left head moves close to the right head, and an open state when the left head moves away from the right head;

wherein the control mechanism is configured to drive the clamping assembly to switch between the clamping state and the open state;

wherein the rotating button mechanism comprises a first connecting plate, an eccentric shaft, a rotating button, and a limiting structure; the first connecting plate is connected to the right connecting portion; the first connecting plate is rotatably connected to the left connecting portion through the eccentric shaft, the rotating button is connected to the eccentric shaft; the rotating button adjusts a distance between the left connecting portion and the right connecting portion by driving the eccentric shaft to eccentrically rotate; the limiting structure is connected to the rotating button; the limiting structure is configured to limit a rotating range of the rotating button;

wherein the crimping pliers further comprise a second connecting plate; the clamping assembly is arranged between the first connecting plate and the second connecting plate; the second connecting plate is connected to the right jaw; the eccentric shaft comprises a first rotating shaft, a second rotating shaft, and a third rotating shaft; the first rotating shaft is rotatably connected to the first connecting plate; the second rotating shaft is connected to the first rotating shaft and is rotatably connected to the left connecting portion; the third rotating shaft is connected to the second rotating shaft and is rotatably connected to the second connecting plate; a rotation axis of the first rotating shaft is parallel to and not coincided with a rotation axis of the second rotating shaft; the rotation axis of the first rotating shaft coincides with a rotation axis of the third rotating shaft; the rotating button is connected to the first rotating shaft and drives the eccentric shaft to rotate around the rotation axis of the first rotating shaft.

* * * * *